US009466416B2

(12) United States Patent
Yokoyama et al.

(10) Patent No.: US 9,466,416 B2
(45) Date of Patent: Oct. 11, 2016

(54) MULTILAYER DEVICE AND MANUFACTURING METHOD OF THE SAME

(71) Applicant: Murata Manufacturing Co., Ltd., Kyoto (JP)

(72) Inventors: Tomoya Yokoyama, Kyoto (JP); Jyunichi Nanjyo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/496,034

(22) Filed: Sep. 25, 2014

(65) Prior Publication Data

US 2015/0015358 A1 Jan. 15, 2015

Related U.S. Application Data

(63) Continuation of application No. PCT/JP2012/077551, filed on Oct. 25, 2012.

(30) Foreign Application Priority Data

May 21, 2012 (JP) ..... 2012-115936

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/292* (2013.01);
(Continued)

(58) Field of Classification Search
CPC ..... H01F 5/00; H01F 27/28
USPC ..... 336/200, 232
See application file for complete search history.

(56) References Cited

U.S. PATENT DOCUMENTS 5,488,765 A 2/1996 Kubota
2009/0068426 A1* 3/2009 Nishizawa ..... H01F 17/0006 428/209
2011/0001599 A1* 1/2011 Takenaka ..... H01F 17/0013 336/200

FOREIGN PATENT DOCUMENTS

CN 101467221 A 6/2009
JP 06-096992 A 4/1994
(Continued)

OTHER PUBLICATIONS

International Search Report issued in Application No. PCT/JP2012/077551 dated Jan. 29, 2013.
Written Opinion issued in Application No. PCT/JP2012/077551 dated Jan. 29, 2013.

*Primary Examiner* — Tsz Chan
(74) *Attorney, Agent, or Firm* — Pearne & Gordon LLP

(57) ABSTRACT

A multilayer inductor device in which parasitic inductance is made smaller while preventing increase in a mounting area of the device and complexity of a wiring pattern, and a manufacturing method of the stated multilayer inductor device. An outer electrode and a terminal electrode are connected to each other through a via hole. A side surface of a non-magnetic member forms a part of an end surface of the device, while the other side surface thereof being in contact with the via hole. A side surface of the via hole that makes contact with the non-magnetic member is opened, which prevents the parasitic inductance from being increased. The via hole being provided in an arbitrary position makes it possible to prevent the wiring pattern from being complicated and a mounting area of the device from being increased.

2 Claims, 4 Drawing Sheets

(51) Int. Cl.

| | |
|---|---|
| ***H01F 17/00*** | (2006.01) |
| ***H01F 27/29*** | (2006.01) |
| ***H01F 41/04*** | (2006.01) |
| ***H01F 41/32*** | (2006.01) |

(52) U.S. Cl.

CPC ..... *H01F41/041* (2013.01); *H01F 41/32* (2013.01); *H01F 2017/0066* (2013.01); *H01F 2027/2809* (2013.01); *Y10T 29/49165* (2015.01)

(56) References Cited

FOREIGN PATENT DOCUMENTS

| | | | |
|---|---|---|---|
| JP | 2001-313212 | A | 9/2001 |
| JP | 2004-040001 | A | 2/2004 |
| JP | 2006-253716 | A | 9/2006 |
| WO | 2007/145189 | A1 | 12/2007 |
| WO | 2011/148678 | A1 | 12/2011 |
| WO | 2012/137386 | A1 | 10/2012 |
| WO | 2012/140805 | A1 | 10/2012 |

* cited by examiner

FORMING THROUGH-HOLES (IN MULTILAYER BODY)

FILLING WITH CONDUCTIVE PASTE

BORING HOLES IN ORTHOGONAL DIRECTION

FILLING WITH NON-MAGNETIC PASTE

FORMING GROOVES

FORMING THROUGH-HOLES

FILLING WITH NON-MAGNETIC PASTE

BORING TWO HOLES IN CONTACT WITH NON-MAGNETIC PASTE

FILLING WITH CONDUCTIVE PASTE

FORMING GROOVES

FORMING THROUGH-HOLES

FILLING WITH CONDUCTIVE PASTE

FORMING THROUGH-HOLES WHILE EACH SPANNING CONDUCTIVE-PASTE FILLED THROUGH-HOLES

FILLING WITH NON-MAGNETIC PASTE

FORMING GROOVES

FORMING THROUGH-HOLES

FILLING WITH CONDUCTIVE PASTE

BORING HOLES IN
ORTHOGONAL DIRECTION

PREPARING NON-MAGNETIC SHEETS
HAVING SAME SHAPE AS HOLES

LAMINATING ALTERNATELY

FORMING GROOVES

MULTILAYER DEVICE AND MANUFACTURING METHOD OF THE SAME

BACKGROUND OF THE INVENTION

1. Field of the Invention

The present invention relates to multilayer devices in which a plurality of substrates including magnetic-member substrates are laminated and manufacturing methods of the stated multilayer devices.

2. Description of the Related Art

Multilayer devices manufactured by laminating a plurality of substrates including magnetic-member substrates and firing the laminated substrates have been known. For example, Patent Document 1 discloses a multilayer inductor device in which laminated are magnetic members in which coil patterns are formed. The multilayer inductor device disclosed in Patent Document 1 is a device such that a non-magnetic member is disposed in an outermost layer and an intermediate layer, and routing of a wiring pattern is carried out within a non-magnetic member layer; consequently, the wiring pattern is not formed on a surface of the device so as to ensure a region for mounting electronic components and to improve direct-current superposition characteristics of the inductor.

However, in the case where a via hole is formed in order to connect mounting electrodes respectively provided on a front surface and a rear surface of the outermost layer of the device, and the via hole is configured to electrically connect the mounting electrodes to each other penetrating through inside of the magnetic member, a conductor in the via hole is completely surrounded by the magnetic member, thereby increasing parasitic inductance. Although GND terminals are frequently provided when ICs and electronic components are mounted on a top surface of a magnetic-member substrate, there is a risk that a difference in potentials of the GND terminals can be generated between the top surface and a bottom surface of the magnetic-member substrate due to the above parasitic inductance. Accordingly, as disclosed in Patent Document 2, for example, such a configuration can be considered that a recessed portion is provided at an end portion of a substrate, an end surface electrode is formed in the recessed portion, and then upper and lower surfaces thereof are electrically connected with each other via the end surface electrode.

Patent Document 1: International Publication No. WO 2007/145189

Patent Document 2: Japanese Unexamined Patent Application Publication No. 2006-253716

BRIEF SUMMARY OF THE INVENTION

However, to electrically connect the upper and lower surfaces to each other via the end surface electrode as disclosed in Patent Document 2, the end surface electrode need be formed near the center of each side of the magnetic-member substrate because the end surface electrode is formed when the magnetic-member substrates are in a state of being collected together. Further, forming the recessed portion raises a problem that a region where electronic components are mounted is reduced.

An object of the present invention is to provide multilayer devices in which parasitic inductance is made smaller while ensuring a region for mounting electronic components, and manufacturing methods of the stated multilayer devices.

A multilayer device according to the present invention is a multilayer body in which a plurality of substrates including magnetic-member substrates are laminated, and a first land electrode for mounting an electronic component is provided on a first surface of an outermost layer of the multilayer body while a second land electrode to be mounted on a substrate is provided on a second surface of the outermost layer of the multilayer body.

The multilayer device according to the present invention includes a via hole which is provided in the magnetic member layer and electrically connects the first land electrode and the second land electrode to each other, and a region between the via hole and an end surface of the multilayer device is formed of a non-magnetic material.

The via hole substantially configures an open magnetic circuit because the non-magnetic material that makes contact with the via hole is interposed between the via hole and the end surface of the multilayer device. Accordingly, parasitic inductance of the multilayer device of the present invention can be made smaller. Further, because the via hole can be disposed at an arbitrary position as long as it is in the vicinity of an end surface of the multilayer body, the degree of freedom of routing a wiring pattern is increased so that a coil pattern can be formed extending to the vicinity of the end surface of the multilayer body.

According to the present invention, parasitic inductance can be made smaller while ensuring a region for mounting electronic components and avoiding complexity of a wiring pattern.

DETAILED DESCRIPTION OF THE INVENTION

Figure 1A:
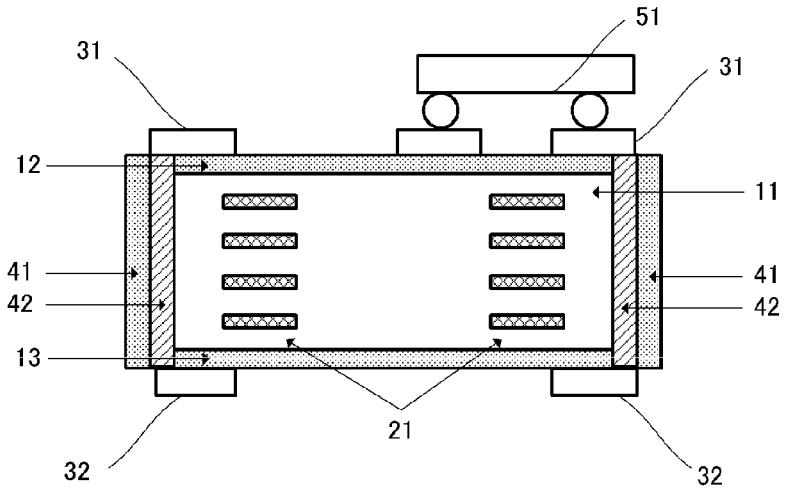
FIGS. 1A and 1B illustrate cross-sectional views of a multilayer inductor device.
Figure 1B:
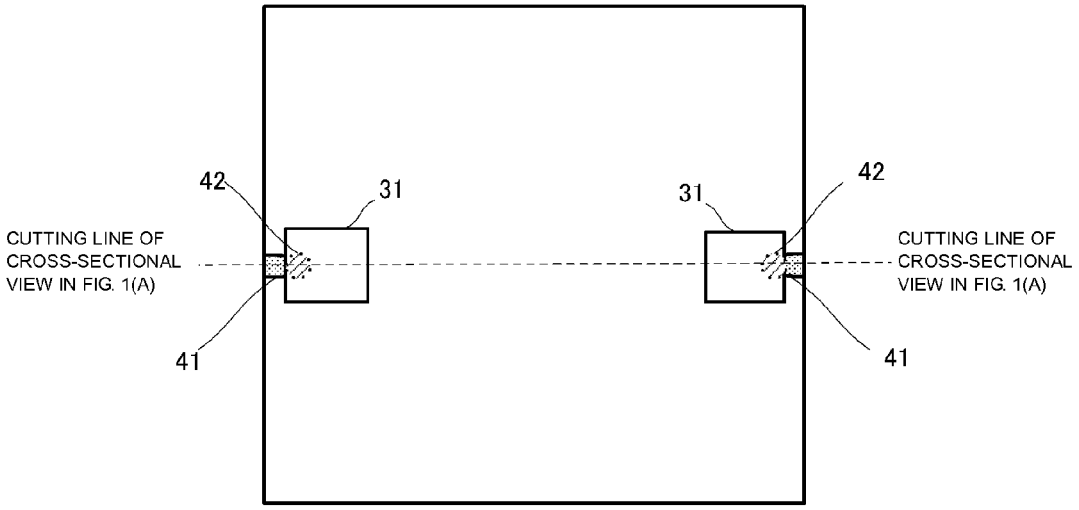

FIG. 1A is a cross-sectional view of a multilayer inductor device according to an embodiment of the present invention, while FIG. 1B is a plan view of the multilayer inductor device. This multilayer device is formed through laminating a plurality of magnetic-member substrates made of magnetic ferrite. The cross-sectional view shown in the present embodiment is such that the upper side of the drawing corresponds to the upper surface side of the multilayer inductance device, while the lower side of the drawing corresponds to the lower surface side of the multilayer inductor device.

A magnetic ferrite layer 11 is formed in the multilayer inductance device in an example of FIG. 1A, and the magnetic ferrite layer 11 is formed through laminating a plurality of ceramic green sheets (magnetic-member substrates) made of magnetic member material. Further, the uppermost surface of the device is formed with a non-magnetic ferrite layer 12 and the lowermost surface of the device is formed with a non-magnetic ferrite layer 13. The non-magnetic ferrite layer 12 and the non-magnetic ferrite layer 13 are formed through laminating the plurality of ceramic green sheets made of non-magnetic member material.

By employing such a configuration, the magnetic ferrite layer 11 is configured to be sandwiched between the non-magnetic ferrite layer 12 and the non-magnetic ferrite layer 13 so as to have an advantage such that strength of the multilayer body is increased by the stress produced at a time of firing due to difference in thermal expansion coefficients of the different materials. Further, by forming a wiring pattern inside the non-magnetic ferrite layer 12 or non-magnetic ferrite layer 13 and connecting the wiring pattern to a surface of the multilayer body through a via hole, it is unnecessary to form a wiring pattern on the surface of the multilayer body. Alternatively, in the case where the wiring pattern is formed in a boundary surface between the magnetic ferrite layer 11 and the non-magnetic ferrite layer 12 or a boundary surface between the magnetic ferrite layer 11 and the non-magnetic ferrite layer 13, the wiring pattern is not needed to be formed on the surface of the multilayer body.

An internal electrode including a coil pattern is formed on part of the substrates of which the multilayer body is configured. The coil pattern is connected along a laminating direction so as to form an inductor 21. The inductor 21 shown in the example of FIG. 1A is disposed inside the magnetic ferrite layer 11.

An outer electrode 31 is formed on the uppermost surface of the device. The outer electrode 31 is a land electrode for mounting electronic components such as an IC, a capacitor, and so on, and an electronic component module including the multilayer inductor device (for example, a DC-DC converter or the like) is configured by mounting various types of semiconductor devices, passive devices, and so on. For example, in FIG. 1A, an IC 51 is mounted. In the present embodiment, although three outer electrodes 31 are illustrated for the sake of explanation, an actual device has a larger number of outer electrodes than the device shown in the drawing.

A terminal electrode 32 is formed on the lowermost surface of the device. The terminal electrode 32 serves, after the multilayer inductor device is shipped as an electronic component module, as a land electrode on the side facing a substrate on which the electronic component module is mounted in an electronic apparatus manufacturing process.

A non-magnetic member 41 included in the device is made from, for example, a non-magnetic paste. The non-magnetic member 41 is formed in a rectangular column penetrating from the uppermost surface of the device to the lowermost surface thereof, and one side of the non-magnetic member 41 is recessed in an arc-like shape when viewed from the top surface of the device, as shown in FIG. 1B. The non-magnetic member 41 may take a cylinder shape or other pillar shapes. In FIG. 1A, one side surface of the non-magnetic member 41 forms a part of the end surface of the device and the other side surface thereof makes contact with a via hole 42 formed of a conductive member. The via hole 42 is provided inside the magnetic member layer of the device. The upper surface side of the via hole 42 is provided immediately under the outer electrode 31. The lower surface side of the via hole 42 is provided immediately above the terminal electrode 32. The outer electrode 31 and the terminal electrode 32 are electrically connected with each other through the via hole 42.

A plurality of substrates made of magnetic ferrite are laminated, thereafter the laminated substrates are bored by punching or the like, then the bored hole is filled with a conductive paste to form each via hole 42. Alternatively, the via hole 42 is formed as follows: that is, ceramic green sheets, which will be used as a plurality of substrates made of magnetic ferrite, are bored by punching or the like sheet by sheet, each bored hole is filled with a conductive paste, and then the ceramic green sheets with the holes are laminated so as to form the via hole 42. The shape of the hole is not intended to be limited to a circle, and the hole may take other shapes such as a rectangle or the like.

The non-magnetic member 41 is formed by laminating a plurality of substrates made of magnetic ferrite, then boring a hole by punching or the like, and filling the bored hole with a non-magnetic paste. Alternatively, the non-magnetic member 41 is formed as follows: that is, ceramic green sheets, which will be used as a plurality of substrates made of magnetic ferrite, are bored by punching or the like sheet by sheet, each bored hole is filled with a non-magnetic paste, and then the ceramic green sheets with the holes are laminated so as to form the non-magnetic member 41.

In the multilayer inductor device, as shown in an example of FIG. 1B, although each of the via holes 42 is positioned in the center of the vicinity of a side of the device when viewed from above, the position of the via hole is not intended to be limited to the center. The via hole may be positioned in a corner of the device when viewed from above. In the case where the via hole is not positioned immediately under the outer electrode 31 or the via hole 42 is not positioned immediately above the terminal electrode 32, wiring configured to electrically connect the via hole 42 to the outer electrode 31 or terminal electrode 32 is provided. This wiring is formed in a boundary surface between the magnetic ferrite layer 11 and the non-magnetic ferrite layer 12 or a boundary surface between the magnetic ferrite layer 11 and the non-magnetic ferrite layer 13. Alternatively, the wiring may be formed inside the non-magnetic ferrite layer 12 or inside the non-magnetic ferrite layer 13.

Next, effects of the via hole 42 and the non-magnetic member 41 will be described.

In general, wiring disposed in a magnetic ferrite layer becomes a parasitic inductor. If the outer electrode 31 and the terminal electrode 32 are electrically connected with each other through a via hole, the parasitic inductor has such a large value of inductance that cannot be ignored.

A switching signal in a DC-DC converter is typically a high-frequency signal of approximately 100 kHz to 6 MHz. Because parasitic inductance becomes a high resistance in a high-frequency region, the switching signal does not go down to GND and in turn appears as noise. In addition, ripple components are superposed on an output voltage so as to degrade the stability of the output voltage.

However, because a part of the via hole 42 is magnetically opened by the non-magnetic member 41, influence of the parasitic inductance can be ignored as described below.

Figure 2:
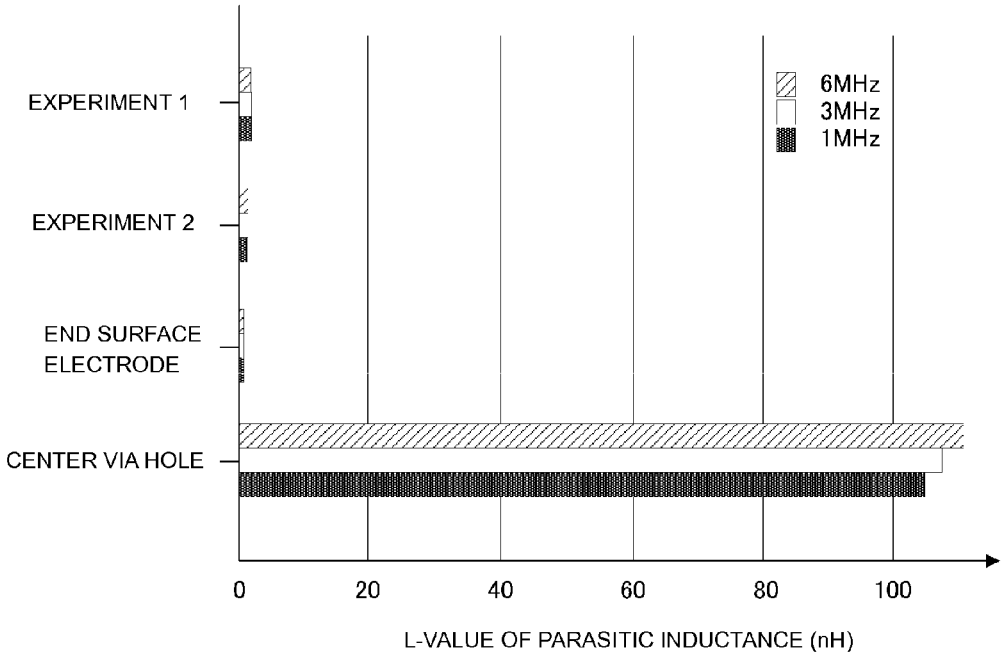
FIG. 2 is a diagram illustrating parasitic inductance.

FIG. 2 illustrates the results of measurement of parasitic inductance generated at frequencies of 1 MHz, 3 MHz, and 6 MHz, respectively. "Experiment 1" is a measurement result in the case where a non-magnetic member was disposed in the center of a side surface of a multilayer inductance device when the device was viewed from above, and a via hole was disposed so as to be in contact with the above non-magnetic material inside the device. "Experiment 2" is a measurement result in the case where a non-magnetic member was disposed in a corner of a multilayer inductance device when the device was viewed from above, and a via hole was disposed so as to be in contact with the non-magnetic member inside the device. "End surface electrode" is a measurement result in the case where the uppermost surface of a device and the lowermost surface thereof were connected to each other by an end surface electrode. "Center via hole" is a measurement result in the case where only a via hole was formed in the center of a device. The parasitic inductance measured in "experiment" 1 and "experiment 2" was so small in comparison with that measured in "center via hole" as to be ignored. Any substantial difference cannot be found between these values and the values of parasitic inductance measured in "end surface electrode".

Accordingly, using the via hole, the multilayer device according to the present embodiment has the same level of parasitic inductance suppression effect as in the case of using the end surface electrode. Further, it is unnecessary to provide a recessed portion on the end surface of the multilayer body because the end surface electrode is not used, which makes it possible to ensure a region for mounting electronic components and avoid complexity of the wiring pattern.

Next, a manufacturing method of the multilayer inductor device according to the present embodiment will be described. The multilayer inductor device is manufactured through the following steps.

First, a conductive paste containing Ag is applied on respective ceramic green sheets, which will be used as the magnetic ferrite layer 11, then a plurality of the ceramic green sheets are laminated so as to form the inductor 21 (coil pattern). In the case where the via hole 42 is not provided immediately under the outer electrode 31 or the via hole 42 is not provided immediately above the terminal electrode 32, a wiring conductive pattern is formed on the upper or lower surface of the device for electrical connection in this application step.

Figure 3A:
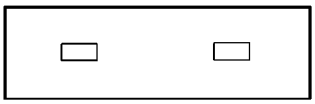
FIGS. 3A-3E are diagrams illustrating manufacturing processes of a multilayer device.
Figure 3B:
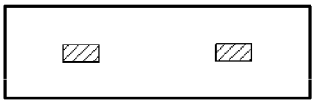
Figure 3C:
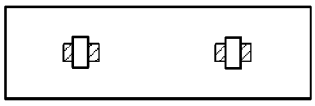
Figure 3D:
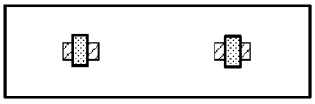

As shown in FIG. 3A, rectangular holes are bored by punching or the like in the multilayer body configured of the plurality of ceramic green sheets having experienced the application step so as to form first through-holes. Next, as shown in FIG. 3B, the first through-holes are filled with the conductive paste (conductive material). Thereafter, as shown in FIG. 3C, additional rectangular holes are bored by punching or the like along a different direction from the direction (along a direction orthogonal to the direction) of the first rectangular through-holes having been previously bored so as to form second through-holes. Subsequently, as shown in FIG. 3D, the second rectangular through-holes, bored along the different direction, are filled with the non-magnetic paste (non-magnetic material). The second through-holes filled with the non-magnetic paste form the non-magnetic members 41 of each of the devices after being broken down, while the first through-holes filled with the conductive paste form the via holes 42.

In the case where the ceramic green sheets, not after being laminated but before being laminated, experience the steps illustrated in FIGS. 3A through 3D, the non-magnetic members 41 and the via holes 42 can also be formed. In this case, the step in which the conductive paste is applied to the ceramic green sheets so as to form the inductor 21 need not be limited to be carried out before the steps illustrated in FIGS. 3A through 3D, and may be carried out after those steps.

Next, an electrode paste whose major component is silver is applied to a surface of a mother multilayer body having been completed so as to form the outer electrode 31 and the terminal electrodes 32. This step may be carried out in the application step in which the inductor 21 is formed.

Figure 3E:
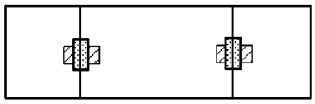

Thereafter, in order to make it possible to break down the mother multilayer body in a predetermined dimension after firing, grooves for the breaking-down are provided through dicing. As shown in FIG. 3E, the grooves extend across the second through-holes filled with the non-magnetic paste and do not extend across the first through-holes filled with the conductive paste. By breaking down the mother multilayer body following the grooves after firing, one side surface of the non-magnetic member 41 of each multilayer inductor device forms a part of an end surface of the device, and the other side surface thereof is configured to be in contact with the via hole 42.

Next, firing is carried out. Through this, a mother multilayer body in which the magnetic ferrite layer is fired (multilayer inductor device before being broken down) is obtained.

Finally, the mother multilayer body is broken down following the grooves cut in the mother multilayer body into a plurality of individual multilayer inductor devices.

The multilayer inductor device manufactured in the manner described above, when electronic components such as the IC 51, a capacitor, and so on are mounted thereon, becomes an electronic component module.

FIGS. 4A-4E illustrate a manufacturing method of the multilayer inductor device, the method being different from the method in FIGS. 3A-3E. The method illustrated in FIGS. 4A-4E is different from the method illustrated in FIGS. 3A-3E in a point that the first through-holes bored first are not filled with the conductive paste but filled with the non-magnetic paste, a point that the second through-holes bored next are filled with the conductive paste, and a point that a different number of the second through-holes are bored.

First, like the example illustrated in FIGS. 3A-E, in order to form the inductor 21, the conductive paste is applied on respective ceramic green sheets. This example is such that the non-magnetic member 41 and the via hole 42 are formed before laminating processing. In the case where the via hole 42 is not positioned immediately under the outer electrode 31 or the via hole 42 is not positioned immediately above the terminal electrode 32, wiring is provided to electrically connect the via hole 42 to the outer electrode 31 or lower electrode 32. This wiring is formed in a boundary surface between the magnetic ferrite layer 11 and the non-magnetic ferrite layer 12 or a boundary surface between the magnetic ferrite layer 11 and the non-magnetic ferrite layer 13. Alternatively, the wiring may be formed inside the non-magnetic ferrite layer 12 or inside the non-magnetic ferrite layer 13.

Figure 4A:
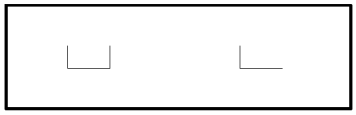
FIGS. 4A-4E are diagrams illustrating a manufacturing process of a multilayer device.
Figure 4B:
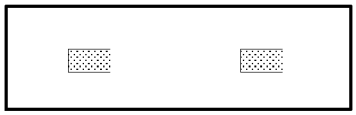
Figure 4C:
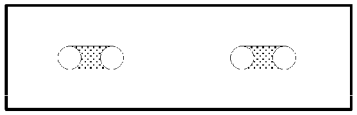
Figure 4D:
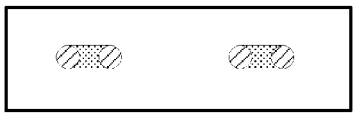

As shown in FIG. 4A, rectangular holes are bored in the respective ceramic green sheets by punching or the like to form the first through-holes. Then, the first through-holes are filled with the non-magnetic paste (non-magnetic material), as shown in FIG. 4B. Thereafter, as shown in FIG. 4C, two circular holes are bored by laser processing or the like in both ends in a longitudinal direction of each of the first through-holes having been bored so as to make contact with the non-magnetic paste, thereby forming the second through-holes. Then, as shown in FIG. 4D, the second through-holes are filled with the conductive paste (conductive material). Thereafter, the ceramic green sheets are laminated so that a mother multilayer body is formed. Through the laminating processing, the first through-holes filled with the non-magnetic paste form the non-magnetic members 41 of each of the devices after being broken down, while the second through-holes filled with the conductive paste forming the via holes 42.

Even in the case where the steps illustrated in FIGS. 4A through 4D are carried out not before laminating the ceramic green sheets but after laminating those sheets, the non-magnetic members 41 and the via holes 42 can be formed.

In the case where the non-magnetic member 41 and the via holes are formed after the laminating processing, the second through-holes are bored not by laser processing but by punching or the like.

Next, the electrode paste whose major component is silver is applied on the surface of the mother multilayer body having been formed so as to form the outer electrode 31 and the terminal electrode 32. This step may be carried out in the application step in which the inductor 21 is formed.

Figure 4E:
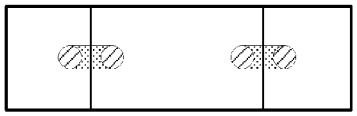

Thereafter, in order to make it possible to break down the mother multilayer body in a predetermined dimension after firing, grooves for the breaking-down are provided through dicing. As shown in FIG. 4E, the grooves extend across the first through-holes filled with the non-magnetic paste and do not extend across the second through-holes filled with the conductive paste. By breaking down the mother multilayer body following the grooves after firing, one side surface of the non-magnetic member 41 of each multilayer inductor device forms a part of an end surface of the device, and the other side surface thereof is configured to be in contact with the via hole 42.

Next, firing is carried out. Through this, a mother multilayer body in which the magnetic ferrite layer is fired (multilayer inductor device before being broken down) is obtained.

Finally, the mother multilayer body is broken down following the grooves cut in the mother multilayer body into a plurality of individual multilayer inductor devices.

FIGS. 5A-5E illustrate a manufacturing method of the multilayer inductor device, the method being different from the method in FIGS. 4A-4E. The method illustrated in FIGS. 5A-5E is different from the method illustrated in FIGS. 4A-4E in the following points: that is, the number of the first through-holes being bored first, the first through-holes being filled with the conductive paste, the number of the second through-holes, and the second through-holes being filled with the non-magnetic paste.

First, in order to form the inductor 21, the conductive paste is applied on the ceramic green sheets. The step in which the non-magnetic members 41 and the via holes 42 are formed before laminating processing is carried out before or after this application step. In the case where the via hole 42 is not positioned immediately under the outer electrode 31 or the via hole 42 is not positioned immediately above the terminal electrode 32, wiring is provided to electrically connect the via hole 42 to the outer electrode 31 or lower electrode 32. This wiring is formed in a boundary surface between the magnetic ferrite layer 11 and the non-magnetic ferrite layer 12 or a boundary surface between the magnetic ferrite layer 11 and the non-magnetic ferrite layer 13. Alternatively, the wiring may be formed inside the non-magnetic ferrite layer 12 or inside the non-magnetic ferrite layer 13.

Figure 5A:
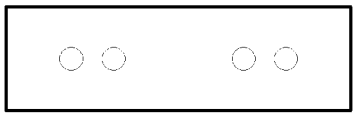
FIGS. 5A-5E are diagrams illustrating a manufacturing process of a multilayer device.
Figure 5B:
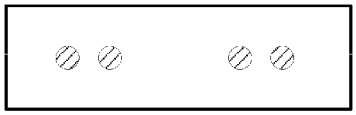
Figure 5C:
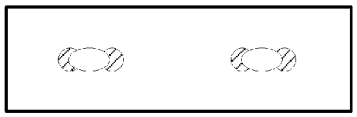
Figure 5D:
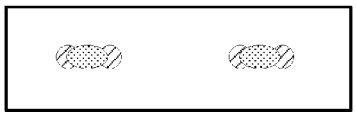

As shown in FIG. 5A, two circular holes are bored in the respective ceramic green sheets by laser processing or the like to form the first through-holes. Then, the first through-holes are filled with the conductive paste (conductive material), as shown in FIG. 5B. Thereafter, as shown in FIG. 5C, two oval holes are bored by laser processing or the like so that each oval hole spans the two first through-holes, thereby forming the second through-holes. Then, as shown in FIG. 5D, the second through-holes are filled with the non-magnetic paste (non-magnetic material). Thereafter, the ceramic green sheets are laminated so that a mother multilayer body is formed. Through the laminating processing, the second through-holes filled with the non-magnetic paste form the non-magnetic members 41 of each of the devices after being broken down, while the second through-holes filled with the conductive paste forming the via holes 42.

Even in the case where the steps illustrated in FIGS. 5A through 5D are carried out not before laminating the ceramic green sheets but after laminating those sheets, the non-magnetic members 41 and the via holes 42 can be formed. In the case where the non-magnetic member 41 and the via holes are formed after laminating processing, the first and the second through-holes are bored not by laser processing but by punching or the like.

Next, the electrode paste whose major component is silver is applied on the surface of the mother multilayer body having been formed so as to form the outer electrode 31 and the terminal electrode 32. This step may be carried out in the application step in which the inductor 21 is formed.

Figure 5E:
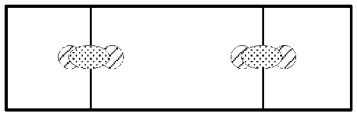

Thereafter, in order to make it possible to break down the mother multilayer body in a predetermined dimension, grooves for the breaking-down are provided through dicing. As shown in FIG. 5E, the grooves extend across the second through-holes filled with the non-magnetic paste and do not extend across the first through-holes filled with the conductive paste. By breaking down the mother multilayer body following the grooves, one side surface of the non-magnetic member 41 of each multilayer inductor device forms a part of an end surface of the device, and the other side surface thereof is configured to be in contact with the via hole 42.

Next, firing is carried out. Through this, a mother multilayer body in which the magnetic ferrite layer is fired (multilayer inductor device before being broken down) is obtained.

Finally, the mother multilayer body is broken down following the grooves cut in the mother multilayer body into a plurality of individual multilayer inductor devices.

FIGS. 6A-6F illustrates a manufacturing method of the multilayer inductor device, the method being different from the method in FIGS. 3A-3E. The method illustrated in FIGS. 6A-6F is different from the method illustrated in FIGS. 3A-3E in a point that not the non-magnetic past but a non-magnetic ferrite sheet is used, and in a point that the non-magnetic members 41 and the via holes are formed before laminating the ceramic green sheets.

Figure 6A:
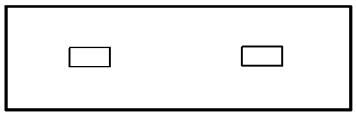
FIGS. 6A-6F are diagrams illustrating a manufacturing process of a multilayer device.
Figure 6B:
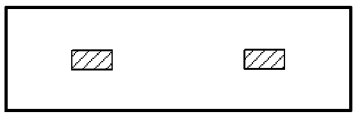
Figure 6C:
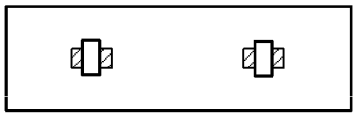
Figure 6D:
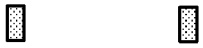
Figure 6E:
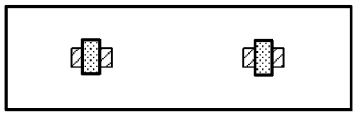

First, in order to form the inductor 21, the conductive paste is applied on the ceramic green sheets. The step in which the non-magnetic members 41 and the via holes 42 are formed before laminating processing is carried out before or after this application step. In the case where the via hole 42 is not positioned immediately under the outer electrode 31 or the via hole 42 is not positioned immediately above the terminal electrode 32, wiring is provided to electrically connect the via hole 42 to the outer electrode 31 or lower electrode 32. This wiring is formed in a boundary surface between the magnetic ferrite layer 11 and the non-magnetic ferrite layer 12 or a boundary surface between the magnetic ferrite layer 11 and the non-magnetic ferrite layer 13. Alternatively, the wiring may be formed inside the non-magnetic ferrite layer 12 or inside the non-magnetic ferrite layer 13. As shown in FIG. 6A, rectangular holes are bored in the respective ceramic green sheets by punching or the like to form the first through-holes. Subsequently, as shown in FIG. 6B, the first through-holes are filled with the conductive paste (conductive material). Thereafter, as shown in FIG. 6C, additional rectangular holes are bored by punching or the like along a different direction from the direction (along a direction orthogonal to the direction) of the first rectangular through-holes having been previously bored so as to form the second through-holes. Subsequently, as shown in FIG. 6D, a plurality of non-magnetic sheets (non-magnetic material) having the same shape as that of the second through-hole are prepared. A non-magnetic sheet larger in size than the second through-hole is cut by laser processing or the like in a shape having the same outer edge as that of the shape of the second through-hole, and a portion of the sheet having the same shape as the second through-hole is left while the other portion of the sheet is removed, thereby forming the above non-magnetic sheet. Thereafter, as shown in FIG. 6E, the ceramic green sheets and the non-magnetic sheets are alternately laminated so that the non-magnetic sheets and the second through-holes match each other, thereby forming a mother multilayer body. The non-magnetic members 41 are formed by laminating the non-magnetic sheets in the second through-holes, while the first through-holes filled with the conductive paste form the via holes 42 through the laminating processing.

Next, the electrode paste whose major component is silver is applied on the surface of the mother multilayer body having been formed so as to form the outer electrode 31 and the terminal electrode 32. This step may be carried out in the application step in which the inductor 21 is formed.

Figure 6F:
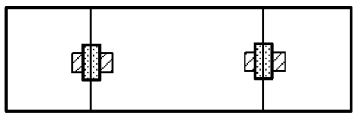

Thereafter, in order to make it possible to break down the mother multilayer body in a predetermined dimension after firing, grooves for the breaking-down are provided through dicing. As shown in FIG. 6F, the grooves extend across the second through-holes filled with the non-magnetic sheets and do not extend across the first through-holes filled with the conductive paste. By breaking down the mother multilayer body following the grooves after firing, one side surface of the non-magnetic member 41 of each multilayer inductor device forms a part of an end surface of the device, and the other side surface thereof is configured to be in contact with the via hole 42.

Next, firing is carried out. Through this, a mother multilayer body in which the magnetic ferrite layer is fired (multilayer inductor device before being broken down) is obtained.

Finally, the mother multilayer body is broken down following the grooves cut in the mother multilayer body into a plurality of individual multilayer inductor devices.

REFERENCE SIGNS LIST

11 MAGNETIC FERRITE LAYER
12 NON-MAGNETIC FERRITE LAYER
13 NON-MAGNETIC FERRITE LAYER
21 INDUCTOR
31 OUTER ELECTRODE
32 TERMINAL ELECTRODE
41 NON-MAGNETIC MEMBER
42 VIA HOLE
51 IC

The invention claimed is:

1. A multilayer device comprising:

a multilayer body in which a plurality of substrates including magnetic-member substrates are laminated;

a first land electrode being provided on an uppermost surface of the multilayer body;

a second land electrode being provided on a lowermost surface of the multilayer body;

a via hole provided inside a magnetic member layer of the multilayer body and electrically connecting the first land electrode and the second land electrode to each other; and a non-magnetic member extending from the uppermost surface to the lowermost surface and contacting with the via hole.

2. An electronic component module comprising:

the multilayer device according to claim 1; and an electronic component mounted on the first land electrode.

* * * * *